United States Patent [19]

Arnt

[11] Patent Number: 4,790,048

[45] Date of Patent: Dec. 13, 1988

[54] SHOELACE LOCK

[76] Inventor: Sharon M. Arnt, 779 Stearns Rd., Bartlett, Ill. 60103

[21] Appl. No.: 116,979

[22] Filed: Nov. 5, 1987

[51] Int. Cl.[4] ..... A43C 7/00

[52] U.S. Cl. ..... 24/117; 24/140; 36/50

[58] Field of Search ..... 24/117 R, 118, 119, 24/120, 140, 142, 144, 141, 147, 148, 115 R; 36/50

[56] References Cited

U.S. PATENT DOCUMENTS

| | | | |
|---|---|---|---|
| 155,156 | 9/1874 | Henry | 24/117 R |
| 2,636,236 | 4/1953 | Peterson | 24/115 R |
| 2,911,697 | 11/1959 | Henderson | 24/117 R |
| 3,418,733 | 12/1968 | Tyrrell, Sr. et al. | 24/117 R |
| 4,514,882 | 5/1985 | Lavielle | 24/117 R |

FOREIGN PATENT DOCUMENTS

| | | | |
|---|---|---|---|
| 80351 | 3/1963 | France | 24/117 R |
| 572449 | 6/1958 | Italy | 24/117 R |
| 14878 | 7/1892 | United Kingdom | 24/117 R |
| 1457313 | 12/1976 | United Kingdom | 24/117 R |

*Primary Examiner*—Victor N. Sakran

[57] ABSTRACT

A shoelace lock including top and bottom plates that cross and grip the laces as the top plate is rotated 180 degrees to the bottom plate and snap locked thereto.

11 Claims, 2 Drawing Sheets

SHOELACE LOCK

BACKGROUND OF THE INVENTION

Shoelace holding devices have had some degree of commercial success over the last twenty years or so basically to prevent the problem of shoelaces coming untied, particularly in childrens shoes. The rather limited commercial success of the shoelace securing devices is largely attributed to their complexity, their difficulty in use and finally their cost.

There is thus the need for a simple, low cost device that is very easy to use that will securely hold shoelaces in place over a considerable length of time without requiring retying.

One of these prior devices is shown in the Mathes U.S. Pat. No. 3,138,839 which discloses a two piece bottom and top plate snap lock device for securing the ends of shoelaces where the bottom and top plates have projections for locking the plates together. The laces extend through a central aperture in the lower plate, then pass through spaced apertures in the top plate, and then pass through grooves in the bottom and top plates respectively. This device, while relatively simple, will not securely lock the laces in position.

There are a plurality of other two piece securing devices for shoelaces that are similar in constructin to the Mathes' shoelace holder including those shown in the Henry U.S. Pat. No. 155,156, in the Henderson U.S. Pat. No. 2,911,697, the Henderson U.S. Pat. No. 2,911,698, the Brodowski U.S. Pat. No. 3,074,135, the Tyrrell, Sr., et al. U.S. Pat. No. 3,577,606, the Shih Chia Mo, et al. U.S. Pat. No. 3,108,343, the Herlau U.S. Pat. No. 4,290,173, the Boden U.S. Pat. No. 4,102,019, and the Harkavy U.S. Pat. No. 4,428,101.

There are still other shoelace holding devices in which the securing device for one lace is separate from the locking device for the other, but these have been found to be too difficult to use. These two piece or separate lace holding devices are exemplified by those shown in the Potts U.S. Pat. No. 423,808, Kasschau U.S. Pat. No. 542,413, the Tyrrell, Sr., U.S. Pat. No. 3,577,606, and the Thurston U.S. Pat. No. 4,258,456.

There are further prior art shoelace holding devices that require, in addition to some holding or locking device, that the laces be tied after they have been knotted, but these have been found largely unsuccessful because they require shoelace tying that could be eliminated with a properly designed shoelace lock. Locking devices of this type are exemplified in the Lee U.S. Pat. No. 657,606, the Girtanner U.S. Pat. No. 647,824, the Bennett U.S. Pat. No. 3,500,508, the Sobel, et al. U.S. Pat. No. 3,537,151, the Blum U.S. Pat. No. 4,545,138, and the Blum U.S. Pat. No. 4,553,293.

Finally, the Lavielle U.S. Pat. No. 4,514,882 shows an anti-theft device for shoelaces of somewhat similar construction to the shoelace locking devices discussed in detail above.

It is a primary object in the present invention to ameliorate the problems noted above in shoelace securing or locking devices.

SUMMARY OF THE PRESENT INVENTION

In accordance with the present invention a shoelace lock is provided that includes top and bottom plates that cross and grip the laces as the top plate is rotated 180 degrees and snap locked to the bottom plate. Both plates are arcuate with spaced lace receiving openings and snap locking is effected by a pair of integral posts that have an interfering fit with another pair of spaced openings in the top plate.

DETAILED DESCRIPTION OF THE PREFERRED EMBODIMENT

Figure 1:
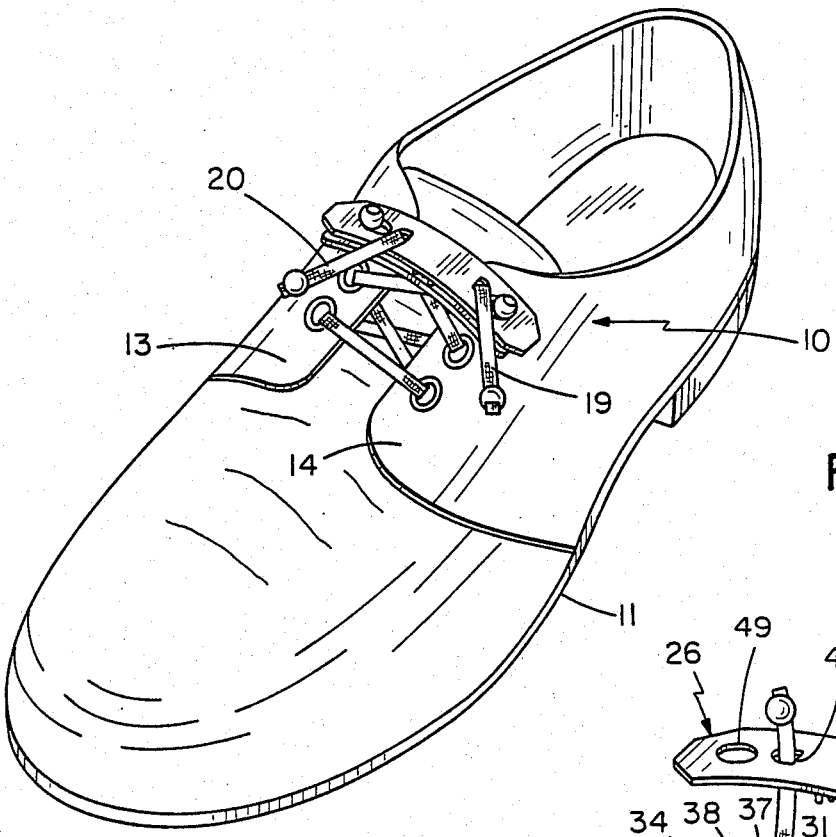
FIG. 1 is a perspective view of a conventional shoe lacing system with the present shoelace lock assembly in place.

Referring to the drawings, and particularly FIGS. 1 to 5, the present shoelace lock assembly 10 is illustrated in FIG. 1 in its assembled position on a conventional shoe 11 having top flaps 13, 14 with eyelets including spaced upper eyelets 16 and 17 with shortened lace end portions 19 and 20 projecting from and threaded through shoelace locking device 10.

Figure 2:
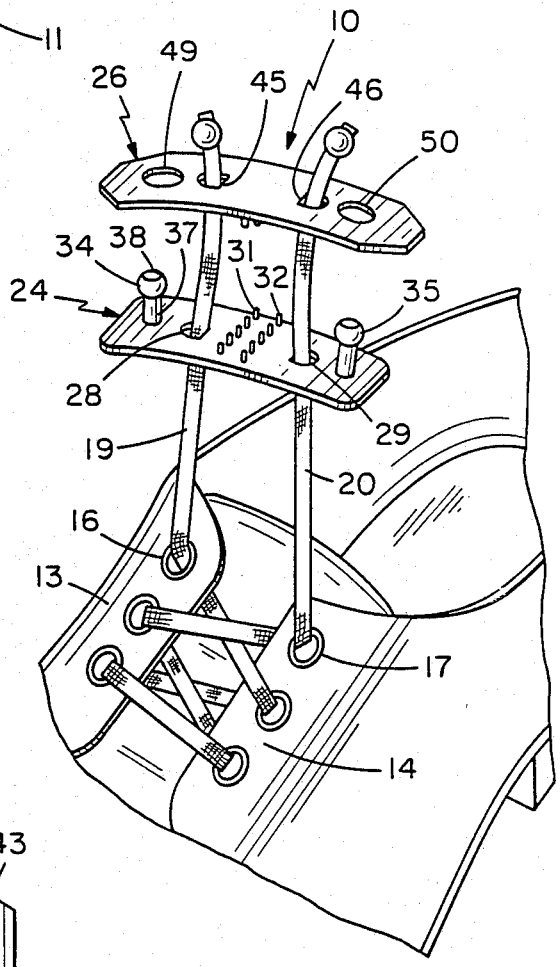
FIG. 2 is a fragmentary perspective of the shoe illustrated in FIG. 1 with the present shoelace locking device in exploded configuration prior to rotation of the top plate with respect to the bottom plate.
Figure 3:
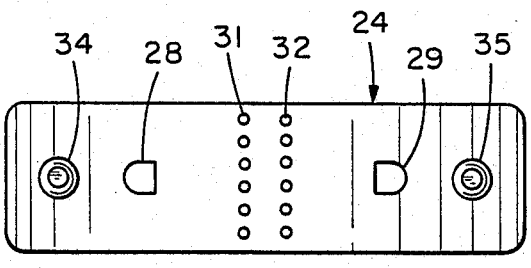
FIG. 3 is an enlarged top view of the bottom plate illustrated in FIGS. 1 and 2.
Figure 4:
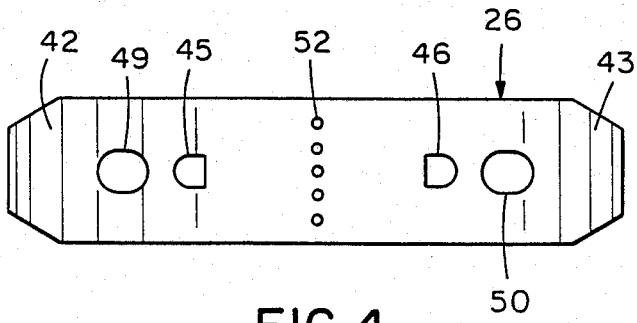
FIG. 4 is an enlarged bottom view of the top plate as illustrated in FIGS. 1 and 2.

Viewing FIGS. 2, 3, 4, the shoelace locking device 10 is seen to include a bottom plate 24 and a top plate 26, each a unitary injection molded part, constructed of a durable readily injection moldable material, such as polypropylene or one of the polyvinyls.

The bottom plate 24 is generally rectangular in configuration from the top and is slightly curved as seen more clearly in FIGS. 2 and 6 to 8, and is thin enough, on the order of 0.065 inches to be slightly flexible, although not intended to be flexed significantly during normal use.

Bottom plate 24 has spaced truncated circular apertures 28 and 29 that are spaced apart approximately the same as the spacing between upper shoe eyelets 16 and 17 although there is no critical relationship between the relative spacing of apertures 28 and 29 and the shoe eyelets. Two rows of small diameter gripping projections 31 and 32 are integrally molded with the bottom plate and extend upwardly therefrom, and are closely spaced with respect to a line transversely bisecting bottom plate 24.

A pair of snap lock posts 34 and 35 are also integrally molded with the bottom plate 24 and project upwardly therefrom and each include a shank portion 37 and an enlarged ellipsoidal head 38.

The top plate 26 is also an injection moldable part constructed of the same material as the bottom plate, and is also generally rectangular in configuration except for the addition of tapered ends 42 and 43 that extend outwardly from the top plate 26 a distance greater than the length of bottom plate 24 to facilitate manipulation of the top plate without the users fingers interfering with the bottom plate 24.

Top plate 26 also has spaced truncated circular openings 45 and 46 spaced apart a distance substantially equal to the bottom plate openings 28 and 29, and like openings 28 and 29 are adapted to receive the lace ends 19 and 20. Also formed in the top plate 26 are longitudinally elongated openings 49 and 50 adapted to receive the posts 34 and 35. The central axes of openings 49 and 50 are spaced apart less than the posts 34 and 35 so that the heads 38 on the posts have a substantial interfering fit with the outer edges of the openings 49 and 50 when top plate 26 is relaxed as seen in FIG. 6.

Figure 8:
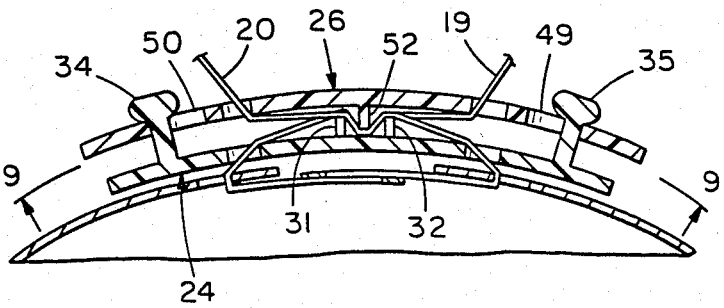

A row of lace gripping projections 52 extend downwardly from the top plate 26 a distance substantially equal to the length of projections 31 and 32 in the bottom plate 24, and this distance is equal to the spaceing between the top and bottom plates when in their assembled position as illustrated in FIG. 8 with the top plate somewhat flexed.

Figure 6:
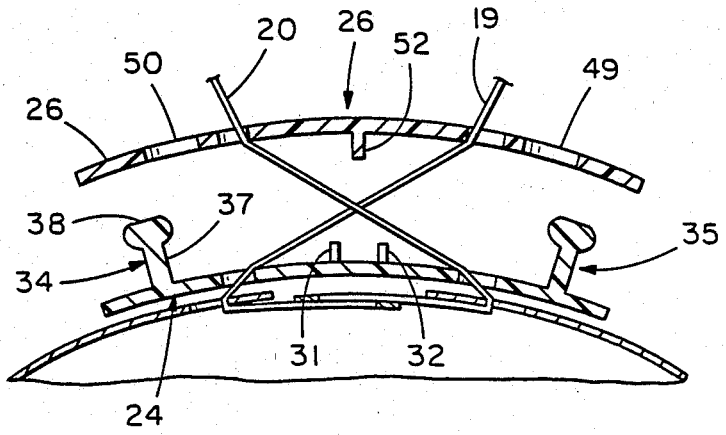
FIGS. 6 through 8 are longitudinal sections through the top and bottom plates illustrating the manner of gripping the laces and snap locking the top plate to the bottom plate.

The top plate 26 is curved in longitudinal section as seen in FIG. 6 and is sufficiently thin to be slightly flexible, so that in the as assembled position of the top plate to the bottom plate as illustrated in FIG. 8, it is curved or bent into a somewhat shorter radius by the posts and the projection rows 31, 32 and 52, providing a spring force intending to lock the top plate upwardly against the under sides of post heads 38 and thereby hold the top and bottom plates in an assembled rattle free configuration.

Figure 5:
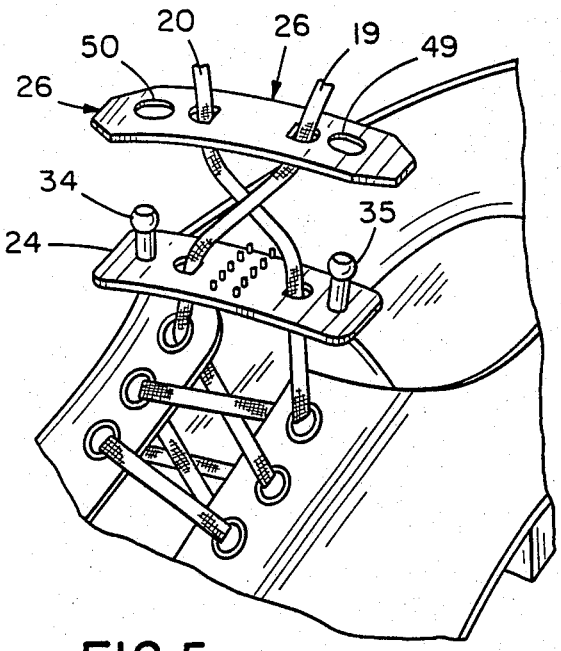
FIG. 5 is a fragmentary perspective similar to FIG. 2 with the top plate rotated 180 degrees with respect to the bottom plate.
Figure 7:
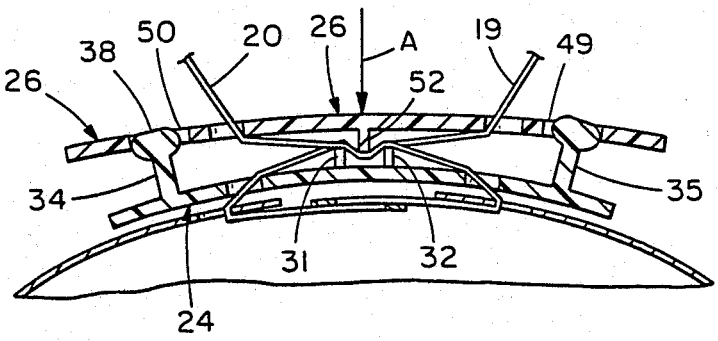

In use and beginning with the device a illustrated in FIG. 2, the lace end portions 19 and 20 are threaded through apertures 28 and 29 in bottom plate 24 and apertures 45 and 46 and top plate 26. The user than grasps the projecting ends of the laces 19 and 20 and tightens the laces to the desired tension and at the same time pushes plates 24 and 26 in their flaps 13 and 14. Holding the laces to the desired tension the user then rotates the top plate 26 180 degrees with respect to the bottom plate 24 thereby crossing the laces between the plates as seen in FIG. 5. This increases lace tension on the bottom plate and forces bottom plate 24 further downwardly. Continuing the manual tension on the laces as seen in the progression of FIG. 6 thru 8, the user pushes the center portion of top plate 26 downwardly approximately at the point of arrow A in FIG. 7, slightly flattening plate 26. The posts 24 and 35 interfere with apertures 50 and 49 in the top plate, but the straightening of top plate 26 elongates the plate sufficiently to enable the heads 38 of the posts to snap through with slight interfering action the apertures 50 and 49. Thereafter, the user releases pressure on the top plate 26 and it assumes its configuration in FIG. 8, which is in a position slightly more curved than its relaxed position causing the ends of the top plate adjacent to the apertures 50 and 49 to spring upwardly against the lower surfaces of the post heads 38 securely locking the plates together. This locking action is further facilitated by the projections 31, 52, 32 which tend to separate the plates 24 and 26 at their mid-points maintaining this over curved configuration of top plate 26.

Figure 9:
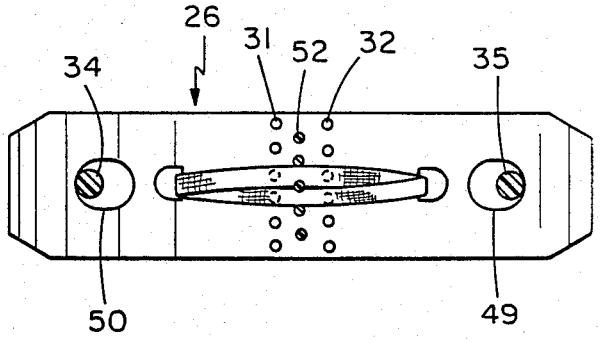
FIG. 9 is a bottom view of the top plate when assembled to the bottom plate taken generally along line 9—9 of FIG. 8.

As the plates 26 and 24 come together during the snap locking of posts 34 and 35, the crossed laces between the plates are engaged by the projection rows 31, 32, and 52, as the upper plate row 52 passes between the lower plate rows 31 and 32. In this way and as seen clearly in FIG. 9, each of the laced portions assumes a V shaped ocnfiguration over the projection rows and is gripped at three points. While the laces are shown spaced for the top and bottom plates adjacent the ends of projections 31, 32, 52 for clarity, it should be understood that these projections are long enough to actually wedge the laces against the surfaces of the top and bottom plates. This gripping of the laces is an important aspect of preventing loosening during use, along with the spring characteristic of top plate 26. The laces are unlocked by inserting the index finger under either end 42, 43 of the top plate and prying this top plate upwardly with sufficient force to snap the top plate off the post heads 38.

I claim:

1. A shoelace lock for threaded shoelaces terminating with a pair of lace end portions extending from spaced shoe eyelets, comprising; a bottom member having spaced openings therein adapted to receive the lace end portions, a top member over the bottom member having means thereon for holding the lace end portions in a spaced condition, a gripping means projecting from at least one of the top and bottom members for gripping the laces as they cross when the top member is rotated 180 degrees with respect to the bottom member with the lace end portions therethrough, and snap lock means for attaching the top and bottom members together after the top member is rotated 180 degrees with respect to the bottom member.

2. A shoelace lock for threaded shoelaces terminating with a pair of lace end portions extending from spaced shoe eyelets, as defined in claim 1, wherein the means for holding the laced end portions in a spaced condition includes spaced openings in the top member.

3. A shoelace lock for threaded shoelaces terminating with a pair of lace end portions extending from spaced shoe eyelets, as defined in claim 1, wherein the means for gripping the laces when crossed includes downward projection means on the top member and cooperating upward projection means on the bottom member.

4. A shoelace lock for threaded shoelaces terminating with a pair of lace end portions extending from spaced shoe eyelets, as defined in claim 3, wherein the top member is somewhat flexible and constructed to bend as the top member is snap locked to the bottom member.

5. A shoelace lock for threaded shoelaces terminating with a pair of lace end portions extending from spaced shoe eyelets, as defined in claim 3, wherein the gripping projections each include a plurality of aligned small projections.

6. A shoelace lock for threaded shoelaces terminating with a pair of lace end portions extending from spaced shoe eyelets, as defined in claim 1, wherein the snap lock means includes widely spaced posts on one of the said members and cooperating slightly interfering apertures in the other of said members.

7. A shoelace lock for threaded shoelaces terminating with a pair of lace end portions extending from spaced eyelets, as defined in claim 4, wherein each of the posts has an enlarged locking head on the top thereof.

8. A shoelace lock for threaded shoelaces terminating with a pair of lace end portions extending from spaced shoe eyelets, comprising; a bottom member having spaced openings therein adapted to receive the lace end portions, a top member over the bottom member having means therein for holding the lace end portions in a spaced condition, a gripping means in at least one of the top and bottom members for gripping the laces as they cross when the top member is rotated 180 degrees with respect to the bottom member with the lace end portions therethrough, and snap lock means for attaching the top and bottom members together after the top member is rotated 180 degrees with respect to the bottom member including widely spaced posts on one of the said members and cooperating slightly interferring apertures in the other of said members, the means for gripping the laces when crossed including downward projection means on the top member and cooperating upward projection means on the bottom member.

9. A shoelace lock for threaded shoelaces terminating with a pair of lace end portions extending from spaced shoe eyelets, as defined in claim 8, wherein the means for holding the laced end portions in a spaced condition includes spaced openings in the top member.

10. A shoelace lock for threaded shoelaces terminating with a pair of lace end portions extending from spaced shoe eyelets, as defined in claim 9, wherein the top member is somewhat flexible and constructed to bend as the top member is snap locked to the bottom member.

11. A shoelace lock for threaded shoelaces terminating with a pair of lace end portions extending from spaced shoe eyelets, comprising; a bottom member having spaced openings therein adapted to receive the lace end portions, a top member over the bottom member having means therein for holding the lace end portions in a spaced, condition, a gripping means in at least one of the top and bottom members for gripping the laces as they cross when the top member is rotated 180 degrees with respect to the bottom member with the lace end portions therethrough, and snap lock means for attaching the top and bottom members together after the top member is rotated 180 degrees with respect to the bottom member including widely spaced posts on one of said members and cooperating slightly interferring apertures in the other of said members, the means for gripping the laces when crossed including downward projection means on the top member and cooperating upward projection means on the bottom member, the top member being somewhat flexible and constructed to bend as the top member is snap locked to the bottom member, said gripping projection means each including a plurality of aligned small projections.

* * * * *